US006613388B1

(12) United States Patent
Kashiwabara et al.

(10) Patent No.: US 6,613,388 B1
(45) Date of Patent: Sep. 2, 2003

(54) METHOD OF PRODUCING A RECORDING SHEET CONTAINING INORGANIC PARTICULATES AND A WATER-SOLUBLE RESIN

(75) Inventors: Yutaka Kashiwabara, Fujinomiya (JP); Kazuhiko Nojo, Fujinomiya (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 09/691,122

(22) Filed: Oct. 19, 2000

(30) Foreign Application Priority Data

Oct. 19, 1999 (JP) ..... 11-297063

(51) Int. Cl.[7] ..... B05D 3/04; B05D 3/12; B05D 1/36

(52) U.S. Cl. ..... 427/348; 427/356; 427/358; 427/359; 427/361

(58) Field of Search ..... 427/356, 358, 427/359, 361, 348

(56) References Cited

U.S. PATENT DOCUMENTS

| | | | | |
|---|---|---|---|---|
| 3,413,139 A | | 11/1968 | Rasmussen et al. | 117/64 |
| 4,592,951 A | * | 6/1986 | Viola | 428/323 |
| 5,360,657 A | | 11/1994 | Kano et al. | 428/207 |
| 5,750,200 A | * | 5/1998 | Ogawa et al. | 427/361 |
| 6,037,050 A | * | 3/2000 | Saito et al. | 428/304.4 |

FOREIGN PATENT DOCUMENTS

| | | |
|---|---|---|
| EP | 0 705 710 A1 | 4/1996 |
| EP | 0 732 219 A2 | 9/1996 |
| EP | 0 818 322 A1 | 1/1998 |
| EP | 0 879 709 A1 | 11/1998 |
| GB | 943361 | 12/1963 |
| JP | 62-11782 | 5/1987 |
| JP | 8-72388 | 3/1996 |
| JP | 9-156202 | 6/1997 |
| JP | 11-115308 | 4/1999 |
| JP | 11-172597 | 6/1999 |

* cited by examiner

*Primary Examiner*—Katherine A. Bareford
(74) *Attorney, Agent, or Firm*—Sughrue Mion, PLLC

(57) ABSTRACT

A recording sheet provided with a coloring material receiving layer containing inorganic particulates and a water-soluble resin is produced in such a manner that production of such a recording sheet is free from restrictions of the composition and properties of coating solutions as well as restrictions of the conditions of coating operation, the coated surface of the recording sheet produced is of high glossiness, and the production of such a recording sheet is carried out in a stable manner without causing lines and unevenness on the coated surface of the recording sheet produced. A coating is applied on a substrate with a slide coater to form a coloring material receiving layer, the coloring material receiving layer is subjected to drying with a dryer, then another coating is applied on the coloring material receiving layer formed with another slide coater to form a overcoat layer, and finally the coated surface is subjected to smoothing/metering treatment with a smoothing/metering unit provided with a bar.

7 Claims, 4 Drawing Sheets

METHOD OF PRODUCING A RECORDING SHEET CONTAINING INORGANIC PARTICULATES AND A WATER-SOLUBLE RESIN

BACKGROUND OF THE INVENTION

1. Field of the Invention

The present invention relates to a method and an apparatus for producing a recording sheet, in particular, for producing a recording sheet having a coloring material receiving layer, which contains inorganic particulates and a water-soluble resin, provided on its substrate, such as a high quality ink jet recording sheet.

2. Description of Related Art

Various types of ink jet methods have been developed up to date; and with their development, various types of ink jet recording sheets have also been developed. Substrates used in these ink jet recording sheets include, for example, not only a variety of resin films but also plain paper, wood free paper (coat paper), and photographic paper. Of these ink jet recording sheets, those provided with a coloring material receiving layer which contains inorganic particulates of fine diameter and a water-soluble resin are now in use as high quality ink jet recording sheets. The recording sheets provided with a coloring material receiving layer containing inorganic particulates and a water-soluble resin also include, for example, those for thermal transfer recording and for electrophotography.

With respect to the production of a recording sheet provided with a coloring material receiving layer containing inorganic particulates and a water-soluble resin, there is disclosed a method in Japanese Patent Laid-Open No. 62-111782 in which a crazing-free recording sheet is produced, while maintaining high ink absorption, high water fastness, and high ink absorption rate, by dividing the coloring material receiving layer into two layers and applying coatings on the layers in sequence. In Japanese Patent Laid-Open No. 8-72388, there is disclosed a method in which a recording sheet of high glossiness is produced by first applying pseudo-boehmite solution to a paper base, second applying silica coating solution to the pseudo-boehmite layer when a water content of the pseudo-boehmite layer is 100 to 450%, and immediately after this, pushing a heated smooth mold against the layer surface. Further, in Japanese Patent Laid-Open No. 11-172597,there is disclosed a method in which a recording sheet of high glossiness is produced by first adjusting a moisture content of its ink coloring material receiving layer formed by applying a coating on a substrate to 200 to 500% by weight, laminating organic polymer films with an arithmetic mean value of surface roughness of 25 nm or less, drying to a moisture content of 5% by weight or lower, followed by stripping the films. In Japanese Patent Laid-Open No. 11-115308, there is disclosed a method in which a recording sheet having high ink absorbability and causing less bleeding and no crazing is produced by providing a coating film of its coloring material receiving layer, which contains inorganic particulates of fine diameter and a water-soluble resin, with a crosslinking agent for crosslinking the water-soluble resin before the above coating film enters its falling drying rate period.

However, in case of the method disclosed in Japanese Patent Laid-Open No. 62-111782, when applying a coating for forming a top layer, such as protective layer, on a sublayer formed by applying/drying a coating for a coloring material receiving layer containing fine particles, bubble trouble is likely to occur, as described in Japanese Patent Laid-Open No. 9-156202, which is a phenomenon that air trapped in voids created in the coloring material receiving layer due to the existence of particulates appears on the protective layer surface of the top layer in the form of traces of bubbles. As a result, the conditions of the coated surface of the recording sheet, as a product, deteriorate, and the smoothness of the same is decreased. Thus the method has a disadvantage in that it is impossible to obtain a recording sheet of high glossiness.

In cases of the methods disclosed in Japanese Patent Laid-Open No. 8-72388 and in Japanese Patent Laid-Open No. 11-172597, the coated surface of a recording sheet is pushed with a mold or laminated with organic polymer films so as to be smoothened; accordingly drying the coating film must be conducted from the back side (the substrate side) of the recording sheet. Thus these methods have disadvantage in that, when using an impermeable film for the substrate of a recording sheet, it is impossible to proceed with drying the coating film.

In case of the method disclosed in Japanese Patent Laid-Open No. 11-115308, in the process of providing a crosslinking agent to an ink coloring material receiving layer, the crosslinking agent is applied on the coloring material receiving layer which does not enter its falling drying rate period yet and is still in the wet state. Accordingly, the conditions of the coated surface of a recording sheet, as a product, may deteriorate depending on the composition and physical properties of the coating solution and on the conditions of coating operation, in particular, the properties of the crosslinking agent, the coating speed, and the coated width; the type of the substrate; and the properties and surface conditions of the coloring material receiving layer containing inorganic particulates and a water-soluble resin in itself. This causes defects in quality, in addition, influences the stability of production because the production is under restrictions of the composition and physical properties of the coating solution as described above. In the cases where a crosslinking agent is applied on the coloring material receiving layer using a slide coater, an extrusion coater or a curtain coater via a bead or curtain film, the bead portion and the curtain film are affected by the entrained wind occurring due to the travel of the substrate and is likely to vibrate; thus the coating of the crosslinking agent is likely to be non-uniform in a direction in which the substrate travels or in a transverse direction of the substrate. In addition, the application of a crosslinking agent is likely to be affected by the wettability by the crosslinking agent on the coloring material receiving layer and affected by the progress of the crosslinking reaction. And when the application of the crosslinking agent is thus destabilized, lines and unevenness are likely to occur on the surface of the products having been subjected to drying. The occurrence of such lines and unevenness not only causes the appearance of the products to deteriorate, but also causes deficiencies in performance, such as glossiness and image quality, of the products as a recording sheet. Particularly in terms of reactivity of the coloring material receiving layer with a crosslinking agent, it is necessary to cure the coloring material receiving layer early by the crosslinking agent, and the reaction is already in progress when a bead is formed; thus the stability in the application of the crosslinking agent is largely affected by the progress of the crosslinking reaction. When using coaters other than those described above, such as roll coater and bar coater, the meniscus of the crosslinking agent solution formed between the roll or bar and the coloring material receiving layer still in the wet state is disturbed depending on the conditions such as wettability by the crosslinking agent on the coloring material receiving layer, reactivity of the coloring material receiving layer with the crosslinking agent and coating speed of the crosslinking agent, which is likely to cause lines and unevenness on the surface of the products having been subjected to drying. When using a dip coater, the amount of the crosslinking agent to be coated cannot be freely controlled. This causes problems in that the formulation and the performance of the crosslinking agent are largely affected, and a worse condition, an excess amount of crosslinking agent applied sags and runs, causing lines on the surface of the products. Further, when using a spray coater for applying a crosslinking agent to the coloring material receiving layer, the traces of the droplets of the crosslinking agent may remain on the products having been subjected to drying, depending on the size of the droplets, the wettability, the coating speed and the coating amount of the crosslinking agent sprayed, causing speck-like lines and evenness thereon.

Then, the present inventors attempted to use a casting drum as measures to resolve these disadvantages. Specifically, after applying a coating on a sublayer to form a top layer or after applying a crosslinking agent on a coloring material receiving layer in the wet state, the present inventors attempted to resolve a decrease in smoothness, lines and unevenness occurring on the coated surface by bringing a casting drum having been subjected to mirror finish into contact with the coated surface and applying temperature and pressure thereto. However, in order to resolve the disadvantages, a casting drum with high temperature and high pressure is needed, and the present inventors found that a currently used casting drum equipment was insufficient to do such a thing. In addition, in the cases where a substrate is impermeable, like a film, a casting drum cannot be used because the progress of drying is not expected. Thus the present inventors' attempt was found to be not a thorough solution to resolve the disadvantages.

On the other hand, unless the above disadvantages are resolved, the quality of the products, such as glossiness, cannot be improved and moreover the yields of the products are decreased due to the existence of lines and unevenness, and the productivity is thus reduced.

And in order to produce a product of high glossiness in a good yield in a stable manner by the currently used methods as described above, it is necessary to optimize not only the coating methods and the conditions of coating operation used in applying the crosslinking agent, but also the physical properties of the crosslinking agent and the coloring material receiving layer. This means that the conditions of a manufacturing process such as the conditions of coating operation and the design of the composition and physical properties of the coating solution are under many restrictions. As a result, great influences on the currently used methods are produced such that the stable manufacturing conditions are within narrow limits. Further, even if a casting drum is installed which can be used at a high temperature and a high pressure, a heavy investment in plant and equipment is required for remolding and optimizing the apparatus and moreover the casting drum is not applicable to the products using a film as a substrate.

SUMMARY OF THE INVENTION

The present invention has been made in light of these situations. Accordingly, an object of the present invention is to provide a method and an apparatus for producing a recording sheet provided with a coloring material receiving layer containing inorganic particulates and a water-soluble resin, thereby the production of such a recording sheet can be free from restrictions of the composition and properties of a coating solution as well as restrictions of the conditions of coating operation, the coated surface of the recording sheet produced is of high glossiness, and the production of such a recording sheet can be carried out in a stable manner without causing lines and unevenness on the coated surface of the recording sheet produced.

In order to accomplish the above object, the present invention is directed to a method of producing a recording sheet that includes the steps of applying a coating on a substrate to form a coloring material receiving layer containing inorganic particulates and a water-soluble resin, applying at least one coating on the coloring material receiving layer to form at least one top layer, and performing, immediately after the topmost layer of the coatings is formed, smoothing/metering treatment to a surface coated with the coloring material receiving layer and the at least one top layer, wherein the substrate is one of plain paper, coat paper, photographic paper, and plastic.

Further, in order to accomplish the above object, the present invention is directed to an apparatus for producing a recording sheet, comprising: a coloring material receiving layer coater which applies a coating on a substrate to form a coloring material receiving layer containing inorganic particulates and a water-soluble resin; a first dryer which dries the coloring material receiving layer; a top layer coater which applies, after or during drying the coloring material receiving layer with the first dryer, at least one coating on the coloring material receiving layer to form at least one top layer; a smoothing/metering unit which performs smoothing/metering treatment to a surface coated with the coloring material receiving layer and the at least one top layer, the smoothing/metering unit being provided to a downstream side of the top layer coater; and a second dryer which dries the at least one top layer having been performed with the smoothing/metering treatment.

According to the present invention, the coated surface of a recording sheet is subjected to smoothing/metering treatment immediately after the topmost layer of multiple coatings is formed. This makes it possible to resolve the deterioration of the coated surface conditions caused by bubble trouble, which is likely to occur when top layers are formed by applying multiple coats on the color material receiving layer containing inorganic particulates and a water-soluble resin, as well as the lines and unevenness occurring on the coated surface due to the unstable application of a coating; accordingly a recording sheet having a coated surface of satisfactory conditions and of high glossiness can be produced. On top of that, in the method of the present invention, since unfavorable conditions occurring on the coated surface, such as bubble trouble, lines and unevenness, are repaired after the formation of the coated surface, the method is free from restrictions of the composition and physical properties of the coloring material receiving layer and the top layers, of the conditions of coating operation, and of the types of the coater used; thus a recording sheet having a satisfactory coated surface can be produced in a stable manner. With respect to the smoothing/metering units, those having a simple structure, such as bar type-, air knife type- and blade type- smoothing/metering units, can be used; accordingly a large-scale remolding is not required for the currently used apparatus for producing a recording sheet.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein.

DETAILED DESCRIPTION OF THE PREFERRED EMBODIMENT

Figure 1:
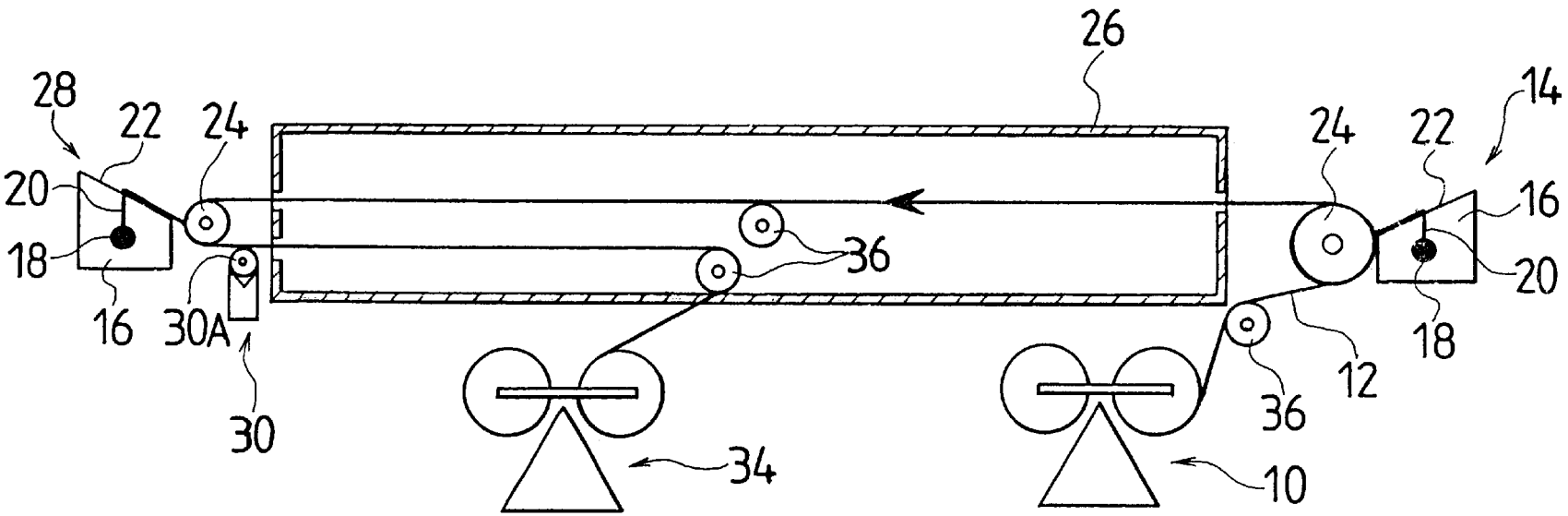
FIG. 1 illustrates a first embodiment of the apparatus for producing a recording sheet embodying the present invention, which incorporates a bar type smoothing/metering unit.

Now preferred embodiments of the method and apparatus for producing a recording sheet of the present invention will be described in detail with reference to the accompanying drawings.

After an intensive and lengthy investigation, the present inventors have found that, in production of a recording sheet provided with a coloring material receiving layer containing inorganic particulates and a water-soluble resin which includes the steps of: applying a coating on a substrate to form a coloring material receiving layer containing inorganic particulates and a water-soluble resin, and applying multiple coats of another coating on the above coloring material receiving layer to form at least one or more coloring material receiving layers different from the above one or applying multiple coats of another coating on the first coloring material receiving layer to form at least one or more over coat layers such as protective layers or applying multiple coats of a crosslinking agent on the first coloring material receiving layer to form at least one or more crosslinking agent layers, when the multiply coated surface of the recording sheet is subjected to smoothing/metering treatment with a smoothing/metering unit provided with any one of a bar, an air knife and a blade immediately after the topmost layer of the multiple coatings is formed, the deterioration of the coated surface conditions caused by bubble trouble as well as the lines and unevenness caused by the unstable application of a coating can be repaired, and a recording sheet having a coated surface of satisfactory conditions and of high glossiness can be produced in a stable manner.

The smoothing/metering treatment herein used means a treatment which has two functions: one is to smoothen a coated surface (smoothing) by the smoothing treatment and the other is to meter the required amount of coating (set amount of coating) by the metering treatment through, for example, scraping the surface layer of the coated surface. Conducting this smoothing/metering treatment to the multiply coated surface immediately after the topmost layer of multiple coatings is formed enables the topmost layer formed to have a required amount of coating and be in a uniform state.

The smoothing/metering units for conducting smoothing/metering treatment include, for example, a bar type-, an air knife type- and a blade type- smoothing/metering units.

The bar type smoothing/metering unit is such that a round bar provided thereto is allowed to come in contact with a coated surface formed on a substrate in a state in which the axial direction of the bar is arranged in the transverse direction of the traveling substrate. The bar is preferably round and its diameter ranges from 2 mm to 200 mm, preferably from 5 mm to 50 mm. The bar is allowed to rotate at a circumference speed the same as the traveling speed of the substrate or within the traveling speed of the substrate ±50% both in the same direction as the travel of the substrate and in the opposite direction to the same. In this case, the lap angle θ of the substrate to the bar is suitably within the range of 0 to 30 degrees. And the bar may have grooves formed therein by winding a wire around it or may have grooves directly cut therein according to the required coating amount, so that metering is performed when the bar and the coated surface come in contact with each other because the bar traps the excessive coating solution in these grooves.

The air knife type smoothing/metering unit is such that a slot-like air nozzle provided thereto is allowed to shoot knife-like air at a coated surface formed on a substrate in a state in which the longitudinal direction of the air nozzle is arranged in the transverse direction of the traveling substrate, thereby the surface layer of the coated surface is scraped and becomes uniform. The velocity of the air shot from the air nozzle is preferably in the range of 10 to 150 m/sec, and the pressure of the same is preferably in the range of 0.01 to 10 kg/cm$^2$, more preferably in the range of 0.5 to 5 kg/cm$^2$. The distance of the topmost layer of the coated surface from the tip of the air nozzle is preferably in the range of 1 to 30 mm and the angle between the air nozzle and the coated surface is preferably in the range of 1 to 50 degrees.

The blade type smoothing/metering unit is such that a blade provided thereto is allowed to come in contact with a coated surface formed on a substrate in a state in which the transverse direction of the blade is arranged in the transverse direction of the substrate, thereby the surface layer of the coated surface is scraped and becomes uniform. The blade used is preferably made of flexible resin materials and the pushing pressure of the blade against the coated surface is preferably in the range of 0.01 to 10 kg/cm$^2$, more preferably in the range of 0.1 to 5 kg/cm$^2$.

More preferably, however, the above conditions set on the bar type-, the air knife type- and the blade type smoothing/metering units are adjusted according to: (1) the required coating amount, (2) the wettability of the coloring material receiving layer, as a top layer, different from the coloring material receiving layer, as a sublayer, or the overcoat layer, (3) the cured conditions of the coloring material receiving layer (sublayer) cured by the crosslinking agent (top layer) when the top layer is a crosslinking agent layer, (4) the composition and physical properties of the coating solution of each of the multiple coatings, and (5) the elapsed time from the instance of forming the topmost layer to the smoothing/metering treatment.

Now the embodiments of an apparatus for producing a recording sheet will be described which are constructed based on the present inventors' findings and knowledge. A crosslinking agent applied as a top layer on a color material receiving layer as a sublayer is used as an example for explanation.

Referring to FIG. 1, there is illustrated a first embodiment of an apparatus for producing a recording sheet of the present invention which incorporates a bar type smoothing/metering unit.

As shown in FIG. 1, first a coating solution for forming a coloring material receiving layer, as a sublayer, containing inorganic particulates and a water-soluble resin is applied with a slide coater 14 on a substrate 12 which is delivered from a delivery unit 10 and travels. Specifically, the coating solution is supplied to a manifold 18 formed inside an application head 16 of the coater 14, allowed to diffuse and run in the transverse direction of the substrate 12, then pushed out toward a slide surface 22 via slit 20, to run down the slide surface 22. The coating solution having run down the slide surface 22 forms a bead in the clearance portion between the tip of the slide surface and the substrate 12 which is engaged and supported by a coating roll 24 and applied on the substrate 12 via the bead. Thus, a coloring material receiving layer is formed on the substrate 12 in a coating amount of, for example, about 100 to 300 g/m$^2$.

Figure 2:
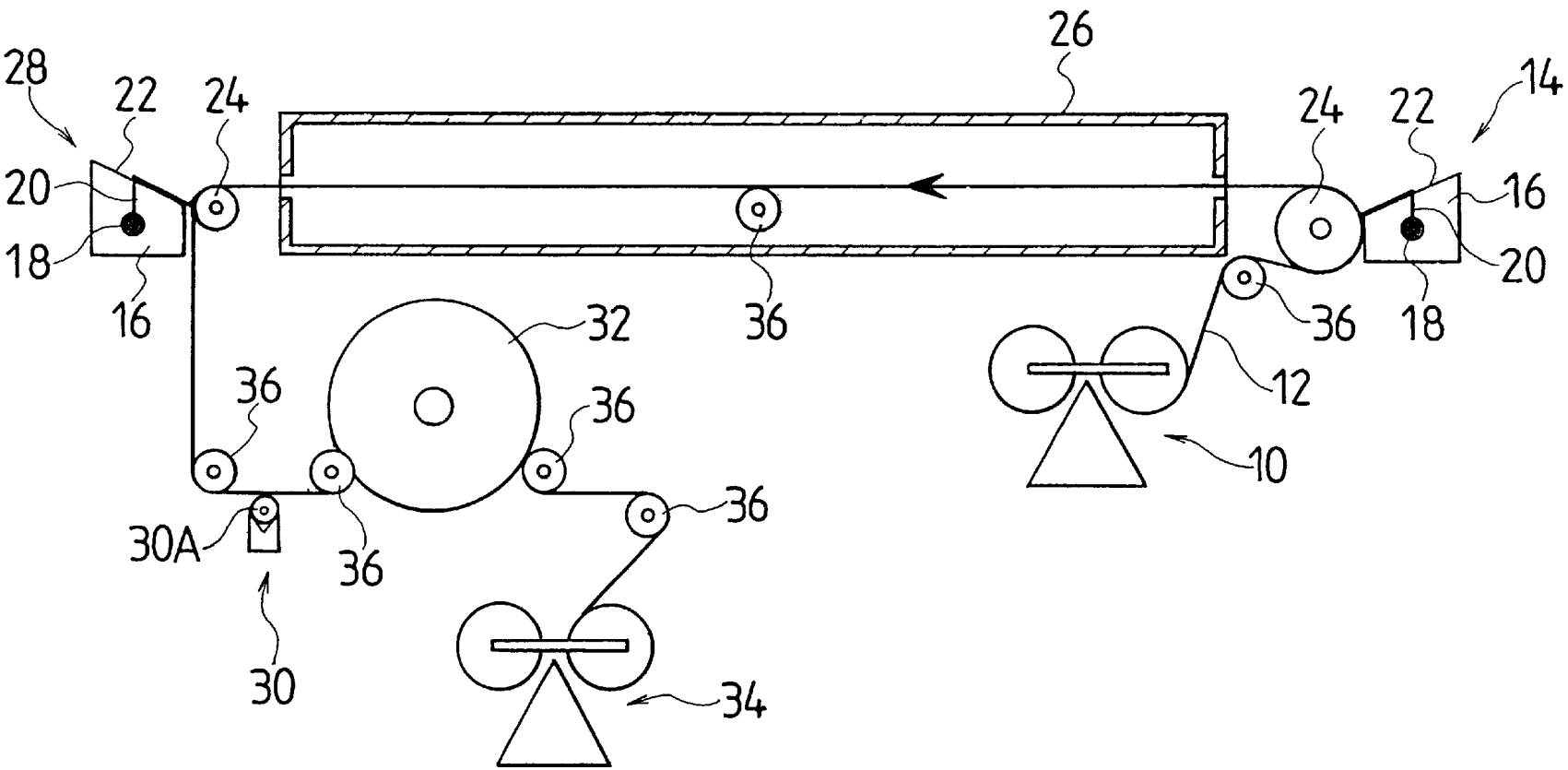
FIG. 2 illustrates a variation of the first embodiment of the apparatus embodying the present invention.

Then the substrate 12 having a coloring material receiving layer formed thereon travels in the drying zone of a dryer 26, so that the coloring material receiving layer is dried. After that a crosslinking agent for forming a top layer is applied on the coloring material receiving layer of the substrate 12 in excess of that previously set with another slide coater 28 arranged on the exit side of the dryer 26. After the application of the crosslinking agent, the top layer is subjected to smoothing/metering treatment with a bar-type smoothing/metering unit 30. In this case, in the process of drying the coloring material receiving layer, before the coloring material receiving layer enters the falling drying rate period, the drying operation is conducted in the air at temperatures ranging from 20 to 180° C., preferably at temperatures ranging from 30 to 150° C. for 0.5 to 5 minutes, and the crosslinking agent is applied before the coloring material receiving layer enters the falling drying rate period or when the moisture content (moisture/solid in %) of the coloring material receiving layer is in the range of 200 to 600%. The moisture content of the coloring material receiving layer is preferably in the range of 200 to 500%, more preferably in the range of 250 to 450%. And preferably smoothing/metering treatment is conducted by the bar 30A in 30 seconds right after the crosslinking agent is applied. Thereby the deterioration of the coated surface conditions caused by bubble trouble as well as the lines and unevenness on the coated surface caused by the unstable application of coatings are repaired, and a coated surface of satisfactory conditions and of high glossiness can be formed. The drying operation after the smoothing/metering treatment may be conducted with the dryer 26 in the air at a temperature of about 180° C. When the substrate is permeable, like paper, the drying operation after the smoothing/metering treatment may be conducted with a casting drum 32 shown in FIG. 2. The recording sheet thus produced is wound up with a windup unit 34.

In the same figure, reference numeral 36 denotes a guide roller for forming a traveling path of the substrate 12. The slide coaters 14 and 28 were used as the coaters for forming the coloring material receiving layer and the crosslinking agent layer, however the present invention is not intended to be limited to these specific examples, and the other coaters such as extrusion coater, curtain coater and bar coater are also applicable. When a crosslinking agent is applied, desirably no other coatings are applied on the substrate 12, except an under coat for improving the coating adhesion properties and wettability of the substrate 12 or except those other than an under coat moisture content of which is 10% or less. The reason is that, in the application of a coating for forming a top layer, if there exists a coating film other than a sublayer on the substrate 12 and the moisture content of the coating film is large, the moisture content of the sublayer is largely affected and the coating for forming a top layer does not go on well.

Figure 3:
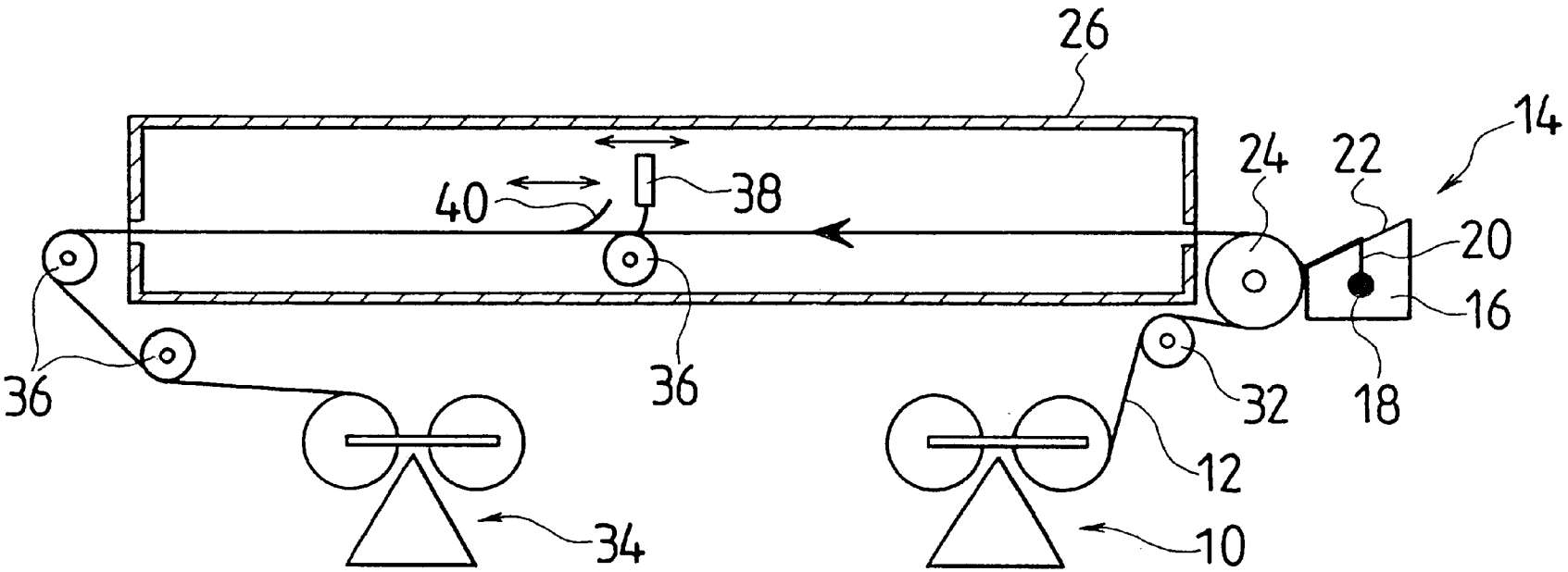
FIG. 3 illustrates a second embodiment of the apparatus for producing a recording sheet embodying the present invention, which incorporates a blade type smoothing/metering unit.

Referring to FIG. 3, there is illustrated a second embodiment of an apparatus for producing a recording sheet of the present invention which incorporates a blade type smoothing/metering unit. The units and members which are the same as shown in FIG. 1 are denoted with the same reference numerals and the detailed description thereof will be omitted.

In the second embodiment, first a coating solution is applied on a substrate 12 with a slide coater 14 to form a coloring material receiving layer, a crosslinking agent is applied on the coloring material receiving layer with a spray coater 38 in the middle of passing the substrate 12 through the drying zone of a dryer 26 before the coloring material receiving layer enters the falling drying rate period, and immediately after that, the crosslinking agent layer is subjected to the smoothing/metering treatment. Specifically, the spray coater 38 and a blade type smoothing/metering unit 40 are arranged in the middle of the drying zone in such a manner that they are allowed to move in the direction shown by the arrow in FIG. 3 according to the coating speed of the crosslinking agent of the spray coater 38 and the drying conditions in the drying zone, so that the crosslinking agent can be applied on the coloring material receiving layer before the coloring material receiving layer enters the falling drying rate period or when the moisture content of the coloring material receiving layer is in the range of 200 to 600% and the smoothing/metering treatment can be smoothly conducted immediately after the application of the crosslinking agent. The moisture content of the coloring material receiving layer is preferably in the range of 200 to 500%, more preferably in the range of 250 to 450%. Although a spray coater was used as the coater for applying a crosslinking agent in this embodiment, the present invention is not intended to be limited to this specific example, the other coaters are also applicable.

The inorganic particulates used in the present invention include, for example, silica particulates, colloidal silica, calcium silicate, zeolite, kaolinite, halloysite, muscovite, talc, calcium carbonate, calcium sulfate, boehmite and pseudo- boehmite. In terms of keeping the clearness of the layer, these inorganic particulates preferably have a refractive index within the range of 1.40 to 1.60. Of all the inorganic particulates described above, silica particulates are particularly preferable. Preferably the average diameter of the primary particles of these inorganic particulates is 20 nm or less, preferably 10 nm or less and more preferably 3 nm or less. And preferably the refractive index is about 1.45.

The water-soluble resins used in the present invention include, for example, resins having a hydroxyl group as a hydrophilic structural unit, such as poly(vinyl alcohol) (PVA), cellulose resins (methyl cellulose (MC), ethyl cellulose (EC), hydroxyethyl cellulose (HEC), carboxymethyl cellulose (CMC) etc.), chitins and starch; resins having an ether linkage, such as poly(ethylene oxide) (PEO), poly (propylene oxide) (PPO), polyethylene glycol (PEG) and poly(vinyl ether) (PVE); and resins having an amide group or amide linkage, such as polyacrylamide (PAAM) and poly(vinylpyrrolidone) (PVP). Further, the water-soluble resins used in the present invention include, for example, resins having a carboxyl group as a dissociative group, such as polyacrylates, maleates, alginates and gelatins; resins having a sulfonic acid group, such as polystyrene sulfonate; resins having an amino group, an imino group, a tertiary amine or a quaternary ammonium salt, such as polyallylamine (PAA), polyethylene imine (PEI), epoxidized polyamide (EPA), poly(vinylpyridine) and gelatins.

The crosslinking agents used in the present invention include, for example, boric acid, borates (for example, orthoborates, $InBO_3$, $ScBO_3$, $YBO_3$, $LaBO_3$, $Mg_3(BO_3)_2$ and $CO_3(BO_3)_2$), diborates (for example, $Mg_2B_2O_5$ and $CO_2B_2O_5$), methaborates (for example, $LiBO_2$, $Ca(BO_2)_2$, $NaBO_2$ and KBO2), tetraborates (for example, $Na_2B_4O_7.10H_2O$), pentaborates (for example, $KB_5O_8.4H_2O$, $Ca_2B_5O_{11}.7H_2O$, $CsB_5O_5$), glyoxal, melamine-formaldehyde (for example, methylolmelamine and alkylated methylolmelamine), methylolurea, resol resin and polyisocyanate. Of all the crosslinking agents above, boric acid and borates are particularly preferable.

Figure 4:
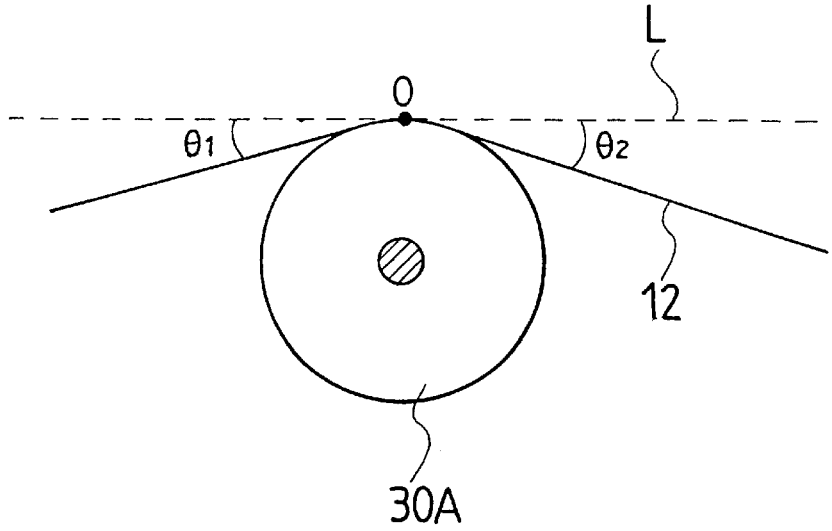
FIGS. 4(*a*) and 4(*b*) illustrate the lap angle of the bar type smoothing/metering unit.
Figure 4:
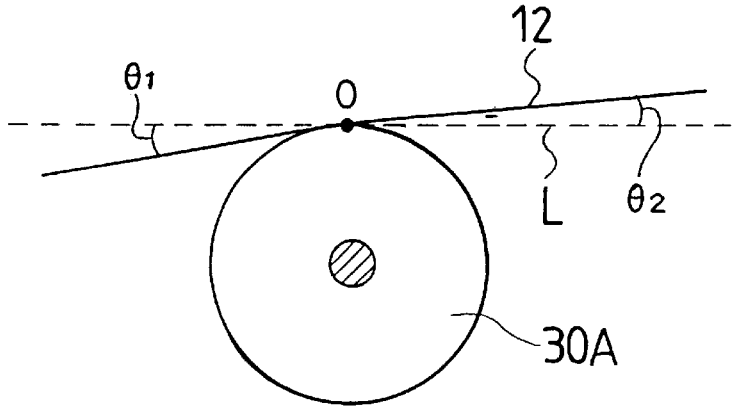

The lap angle (θ) mentioned in the description of the bar type smoothing/metering unit means as follows: when drawing a horizontal line on a bar 30A in such a manner as to allow the line to pass through the center O of the coated surface at which the bar 30A comes in contact with a substrate 12, as shown in FIGS. 4(*a*) and 4(*b*), if the positions of the substrate 12 before and after the bar 30A came in contact with it are on the same side relative to the horizontal line L, as shown in FIG. 4(*a*), the θ is represented as the sum of the angle ($\theta_1$) formed by the horizontal line L and the substrate 12 before it comes in contact with the bar 30A and the angle ($\theta_2$) formed by the horizontal line L and the substrate 12 after it comes in contact with the bar 30A; on the other hand, if the positions of the substrate 12 before and after the bar 30A came in contact with it are on the opposite side relative to the horizontal line L, as shown in FIG. 4(*b*), the θ is represented as the absolute value of the difference between the angle ($\theta_1$) formed by the horizontal line L and the substrate 12 before it comes in contact with the bar 30A and the angle ($\theta_2$) formed by the horizontal line L and the substrate 12 after it comes in contact with the bar 30A.

EXAMPLES

Example 1

In Example 1, a coating was applied on a substrate in a coating amount of 100 g/m$^2$ and a coating width of 1.5 m with a slide coater to form a coloring material receiving layer containing inorganic particulates and a water-soluble resin in the composition shown in Table 1. The coloring material receiving layer was subjected to drying in the drying zone of a dryer in the air at dry-bulb temperatures ranging from 30° C. to 80° C. and at a dew-point temperature of 0° C., so as to form a porous layer void percentage of which was 60%. After the drying, another coating was applied on the coloring material receiving layer in a coating amount of about 60 cm$^3$/m$^2$, which was in excess of that actually required (set amount of coating) by 10 cm$^3$, with an extrusion coater to form an overcoat layer having the composition shown in Table 2. Three seconds after that, the overcoat layer was subjected to smoothing/metering treatment with a smoothing/metering unit provided with a bar with a diameter 25 mm, then subjected to drying, so as to produce a recording sheet.

Comparative Example 1

In Comparative Example 1, a recording sheet was produced in the same manner as in Example 1, except that the coating for forming the overcoat layer was applied on the coloring material receiving layer in a coating amount of 50 cm$^3$/m$^2$, which was just the same as that actually required, and the overcoat layer formed was not subjected to smoothing/metering treatment.

As a result, in case of the Comparative Example 1, when applying the coating for forming the overcoat layer on the coloring material receiving layer, the coating seeped largely into the coloring material receiving layer as a porous layer, and fine turbulence and lines were observed on the coated surface of the recording sheet after drying. In addition, what is called bubble trouble, which is the phenomenon that the air considered to be trapped in the porous layer appears in the coated surface in the form of bubbles, occurred sporadically.

On the other hand, in case of Example 1, the coated surface defects, such as turbulence, lines and bubble trouble, as observed in the Comparative Example 1 were resolved by the smoothing/metering treatment, and a coated surface of satisfactory conditions and of high glossiness was obtained. In this case, even if bubble trouble occurs due to the air trapped in the coloring material receiving layer as a porous layer, the coated surface defects, such as bubble trouble, can be resolved by the smoothing/metering treatment; accordingly the composition and physical properties of the coloring material receiving layer are never restricted.

TABLE 1

| Composition of Coloring Material Receiving Layer | Compounding Ratio |
|---|---|
| (1) Anhydrous Silica Particulates<br>(Aerogel 300, manufactured by Japan Aerogel Co., Ltd.)<br>Average Diameter of Primary Particles: 7 nm<br>Silanol Group on Surface: 2 to 3/nm$^2$<br>Refractive Index: 1.45 | 10 parts by weight |
| (2) Poly(vinyl alcohol)<br>(PVA 440, manufactured by Kuraray Co., Ltd.)<br>Degree of Saponification: 81.8%<br>Degree of Polymerization: 4000 | 3.3 parts by weight |
| (3) Ion-exchanged Water | 136.0 parts by weight |

Notes: All the figures given in parts by weight represent the compounding ratio of the solids content or the nonvolatile content.

The anhydrous silica particulates in Table 1 were added to ion-exchanged water (73.3 parts by weight) and dispersed with a high-speed rotating wet colloid mill (Cleamix, manufactured by M Technique Co., Ltd.) under the condition of 10000 rpm for 20 minutes. Then poly(vinyl alcohol) solution (prepared by dissolving in the rest of ion-exchanged water (62.7 parts by weight)) was added to the above solution and dispersed under the same conditions as above, so as to prepare a coating solution for forming a coloring material receiving layer.

TABLE 2

| Composition of Overcoat Layer | Compounding Ratio |
|---|---|
| (1) Poly(vinyl alcohol)<br>(PVA 440, manufactured by Kuraray Co., Ltd.)<br>Degree of Saponification: 81.8%<br>Degree of Polymerization: 4000 | 5 parts by weight |
| (2) Ion-exchanged Water | 95 parts by weight |

Notes: All the figures given in parts by weight represent the compounding ratio of the solids content or the nonvolatile content.

The poly(vinyl alcohol) in Table 1 was added to ion-exchanged water and dispersed with a high-speed rotating wet colloid mill (Cleamix, manufactured by M Technique Co., Ltd.) in the same manner as in case of preparing the coloring material receiving layer.

Example 2

A coating was applied on a substrate in a coating amount of 150 g/m$^2$ and a coating width of 1.0 m with a slide coater to form a coloring material receiving layer containing inorganic particulates and a water-soluble resin in the composition shown in Table 1. The coloring material receiving layer was subjected to drying in the drying zone of a dryer in the air at a dry-bulb temperature of 120° C. and at a dew-point temperature of 0° C., so as to form a porous layer void percentage of which was 60%. At the time when the moisture content of the coloring material receiving layer was 500%, a crosslinking agent having the composition shown in Table 3 was applied on the coloring material receiving layer in an amount of 60 $cm^3/m^2$, which was in excess of that actually required, with an extrusion coater. Five seconds after the application of the crosslinking agent, the overcoat layer was subjected to smoothing/metering treatment with a smoothing/metering unit provided with an air knife, then subjected to drying, so as to produce a recording sheet. In this case, the air pressure of the air knife, the distance between the air nozzle of the air knife and the film surface, and the angle between the air nozzle and the film surface were set for 1.5 $kg/cm^2$, 15 mm and 25 degrees, respectively. The application of the crosslinking agent was conducted while increasing the coating speed gradually so as to destabilize a bead intentionally.

Comparative Example 2

In Comparative Example 2, a recording sheet was produced in the same manner as in the Example 2, except that the crosslinking agent was applied on the coloring material receiving layer in a coating amount of 50 $cm^3/m^2$, which was just the same as that actually required, and the crosslinking agent layer formed was not subjected to smoothing/metering treatment.

As a result, in case of the Comparative Example 2, the coating of the crosslinking agent was satisfactory when the coating speed was 2 m/minute and the coating amount was 50 $cm^3/m^2$. However, as the coating speed was increased higher than 2 m/minute, the bead of the extrusion coating became unstable, causing the coating of the crosslinking agent to be non-uniform. And lines and unevenness, which is attributed to the above non-uniform coating of the crosslinking agent, occurred on the coated surface of the recording sheet after drying. These lines and unevenness were never resolved by adjusting the distance between the tip of the extrusion die block and the film surface or adjusting the surface tension of the coloring material receiving coating solution and the crosslinking agent, unless the coating speed was changed to as low as less than 2 m/minute.

On the other hand, in case of Example 2, the coated surface defects, such as lines and unevenness, as observed in the Comparative Example 2 were resolved by the smoothing/metering treatment, and a coated surface of satisfactory conditions and of high glossiness was obtained. In this case, even if speckle-like unevenness occurs due to the destabilizing factors in the coating operation of the crosslinking agent, such coated surface defects can be resolved by the smoothing/metering treatment; accordingly obtaining a satisfactory coated surface is free from restrictions of the conditions under which coating operation of a crosslinking agent is conducted.

TABLE 3

| Composition of Crosslinking Agent | Compounding Ratio |
|---|---|
| (1) Boric Acid 6% | 22.5 parts by weight |
| (2) 10% Surfactant Aqueous Solution (F-144D, manufactured by Dainippon Ink and Chemicals, Inc.) | 1.8 parts by weight |
| (3) Ion-exchanged Water | 55.5 parts by weight |
| (4) 10% Polyallylamine Aqueous Solution (Quaternary Ammonium Salt Polymer: PPA-10C, manufactured by Nitto Boseki Co., Ltd.) | 7.2 parts by weight |
| (5) 60% Quaternary Ammonium Salt Polymer Aqueous Solution (Polyfix 700, manufactured by Showa Highpolymer Co., Ltd.) | 3.0 parts by weight |

Notes: All the figures given in parts by weight represent the compounding ratio of the solids content or the nonvolatile content.

The boric acid and the surfactant in Table 3 were added to ion-exchanged water and dispersed with the aforementioned high-speed rotating wet colloid mill, then 10% polyallylamine aqueous solution and 60% quaternary ammonium salt polymer aqueous solution were added and dispersed in the same manner as above, so as to prepare a crosslinking agent solution.

Example 3

In Example 3, a coating was applied on a substrate in a coating amount of 100 $g/m^2$ and a coating width of 1.5 m with a slide coater to form a coloring material receiving layer containing inorganic particulates and a water-soluble resin in the composition shown in Table 1. Then the coloring material receiving layer was subjected to drying in the drying zone of a dryer in the air at dry-bulb temperatures ranging from 30° C. to 80° C. and at a dew-point temperature of 0° C., so as to form a porous layer void percentage of which was 60%. After the drying, the crosslinking agent of Table 3 was applied on the coloring material receiving layer in a coating amount of 60 $cm^3/m^2$, which was in excess of that actually required, with a spray coater. Three seconds after the application of the crosslinking agent, the crosslinking agent layer was subjected to smoothing/metering treatment with a smoothing/metering unit provided with a bar having a wire wound around it, then subjected to drying, so as to produce a recording sheet. In this case, the wire bar was allowed to rotate in the direction in which the substrate travels and the circumferential speed of the rotation of the wire bar was set for the same as the traveling speed of the substrate or the traveling speed of the substrate ±50%. And the lap angle of the wire bar to the substrate was set for 5 degrees and the tension of the substrate for 1 kg/50 cm.

The application of the crosslinking agent was conducted while gradually increasing the diameter of the sprayed particles so as to destabilize the application of the crosslinking agent intentionally.

Comparative Example 3

In Comparative Example 3, a recording sheet was produced in the same manner as in Example 3, except that the crosslinking agent was applied on the coloring material receiving layer in a coating amount of 50 $cm^3/m^2$, which was just the same as that actually required, and the crosslinking agent layer formed was not subjected to smoothing/metering treatment.

As a result, in case of the Comparative Example 3, the coating of the crosslinking agent was somehow satisfactory when the diameter of the sprayed particles was 30 $\mu$m or smaller and the coating amount was 50 $cm^3/m^2$. However, when the particle diameter was increased to about 50 μm and the coating amount was decreased to less than 50 $cm^3/m^2$, a recording sheet having a coated surface of satisfactory conditions could not be obtained even though the balance of the surface tensions of the coloring material receiving layer and the crosslinking agent was adjusted and the coating speed was decreased. And speckle-like unevenness could not be resolved, either.

On the other hand, in case of the Example 3, the speckle-like unevenness could be resolved by the smoothing/metering treatment, and a coated surface of satisfactory conditions and of high glossiness was obtained. In this case, even if speckle-like unevenness occurs due to the destabilizing factors in the coating operation of the crosslinking agent, such coated surface defects can be resolved by the smoothing/metering treatment; accordingly obtaining a satisfactory coated surface is free from restrictions of the conditions under which coating operation of a crosslinking agent is conducted.

Further, it has been found that winding a wire around the bar allows the metering of the coating amount depending on the wire's thickness.

Example 4

In Example 4, a coating was applied on a substrate in a coating amount of 100 $g/m^2$ and a coating width of 1.5 m with a slide coater to form a coloring material receiving layer containing inorganic particulates and a water-soluble resin in the composition shown in Table 1. Then the coloring material receiving layer was subjected to drying in the drying zone of a dryer in the air at dry-bulb temperatures ranging from 30° C. to 80° C. and at a dew-point temperature of 0° C., so as to form a porous layer void percentage of which was 60%. After the drying, the crosslinking agent shown in Table 3 was applied on the coloring material receiving layer in a coating amount of 60 $cm^3/m^2$, which was in excess of that actually required, with a bar coater. In this case, the clearance between the bar and the coloring material receiving layer was set for 2 mm so as not to disturb the coloring material receiving layer still in the wet state. The coating was conducted in both cases where the bar was rotated in the same direction as the travel of the substrate (forward rotation) and in the opposite direction to the travel of the substrate (backward rotation). Three seconds after the application of the crosslinking agent, the crosslinking agent layer was subjected to smoothing/metering treatment with a smoothing/metering unit provided with a bar having a wire wound around it, then subjected to drying, so as to produce a recording sheet.

The application of the crosslinking agent was conducted while gradually increasing the traveling speed of the substrate so as to destabilize the application of the crosslinking agent intentionally.

Comparative Example 4

In Comparative Example 4, a recording sheet was produced in the same manner as in Example 4, except that the crosslinking agent was applied on the coloring material receiving layer in a coating amount of 50 $cm^3/m^2$, which was just the same as that actually required, and the crosslinking agent layer formed was not subjected to smoothing/metering treatment.

As a result, in case of Comparative Example 4, the meniscus created between the bar and the coloring material receiving layer was largely disturbed as the traveling speed of the substrate was increased, even when the bar was rotated forward and when the bar was rotated backward. And when the clearance was wide, the meniscus was broken. When the clearance was narrow, a large meniscus was created locally, which caused a broad line to occur on the coated surface of the recording sheet after drying.

On the other hand, in case of Example 4, broad line-like unevenness could be resolved by the smoothing/metering treatment, and a coated surface of satisfactory conditions and of high glossiness was obtained. In this case, even if broad line-like unevenness occurs due to the destabilizing factors in the coating operation of the crosslinking agent, such coated surface defects can be resolved by the smoothing/metering treatment; accordingly obtaining a satisfactory coated surface is free from restrictions of the conditions under which coating operation of a crosslinking agent is conducted.

Example 5

In Example 5, a coating was applied on a substrate in a coating amount of 100 $g/m^2$ and a coating width of 1.5 m with a slide coater to form a coloring material receiving layer containing inorganic particulates and a water-soluble resin in the composition shown in Table 1. Then the coloring material receiving layer was subjected to drying in the drying zone of a dryer in the air at dry-bulb temperatures ranging from 30° C. to 80° C. and at a dew-point temperature of 0° C., so as to form a porous layer void percentage of which was 60%. After the drying, the crosslinking agent shown in Table 3 was applied on the coloring material receiving layer in a coating amount of 60 $cm^3/m^2$, which was in excess of that actually required, with a bar coater. In this case, the clearance between the bar and the coloring material receiving layer was set for 2 mm so as not to disturb the coloring material receiving layer still in the wet state. The coating was conducted in both cases where the bar was rotated in the same direction as the travel of the substrate (forward rotation) and in the opposite direction to the travel of the substrate (backward rotation). Three seconds after the application of the crosslinking agent, the crosslinking agent layer was subjected to smoothing/metering treatment with a smoothing/metering unit provided with a blade made of resin, then subjected to drying, so as to produce a recording sheet.

In this case, the pushing pressure of the blade against the coated surface was set for 3 $kg/cm^2$.

The application of the crosslinking agent was conducted while gradually increasing the traveling speed of the substrate so as to destabilize the application of the crosslinking agent intentionally.

Comparative Example 5

In Comparative Example 5, a recording sheet was produced in the same manner as in Example 5, except that the crosslinking agent was applied on the coloring material receiving layer in a coating amount of 50 $cm^3/m^2$, which was just the same as that actually required, and the crosslinking agent layer formed was not subjected to smoothing/metering treatment.

As a result, in case of Example 5 in which smoothing/metering treatment was conducted with a blade, broad line-like unevenness as observed in case of the Comparative Example 5 could be resolved, like the Example 4, and a coated surface of satisfactory conditions and of high glossiness was obtained.

As described above, according to the method and the apparatus of the present invention for producing a recording sheet provided with a coloring material receiving layer containing inorganic particulates and a water-soluble resin, the multiply coated surface of the recording sheet produced is subjected to smoothing/metering treatment immediately after the topmost layer of the multiple coatings is formed; thus the production of such a recording sheet can be free from restrictions of the composition and physical properties of a coating solution as well as restrictions of the conditions of coating operation, the coated surface of the recording sheet produced is of high glossiness, and the production can be carried out in a stable manner without causing lines and unevenness on the coated surface of the recording sheet produced.

Further, according to the method and the apparatus for producing a recording sheet embodying the present invention, the production of such a recording sheet can be free from restrictions of the composition and physical properties of a coating solution as well as restrictions of the conditions of coating operation; accordingly the coating speed can be increased, and hence the productivity.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A method for producing a recording sheet, comprising the steps of:

providing an impermeable substrate;

applying a coating on the substrate to form a first coloring material receiving layer containing inorganic particulates and a water-soluble resin;

applying at least one coating on the first coloring material receiving layer to form at least one top layer; and performing, immediately after the topmost layer of the coatings is formed, by a coating device, smoothing and metering treatments to the topmost layer simultaneously by a smoothing and metering device for conducting smoothing/metering treatments.

2. The method according to claim 1, wherein the smoothing/metering treatment is performed within 30 seconds after the topmost layer of the coatings is formed.

3. The method according to claim 1, wherein the coating for forming the topmost layer is applied in excess of a required amount and the topmost layer is subjected to metering through the smoothing/metering treatment to have the required amount of coating.

4. The method according to claim 1, wherein the at least one top layer is selected from one of:

a second coloring material receiving layer haying a composition different from that of the first coloring material receiving layer;

an overcoat layer; and a crosslinking agent layer.

5. The method according to claim 1, wherein when applying the coating for forming the topmost layer, a moisture content of the layer or layers other than the topmost layer ranges from 200% to 600%.

6. The method according to claim 1, wherein when applying the coating for forming the topmost layer, the layer or layers other than the topmost layer consist of at least one of:

an under coat layer for improving coating adhesion properties and wettability of the substrate; and a coating film moisture content of which is at most 10%.

7. A method for producing a recording sheet, comprsing the steps of:

providing an impenneable substrate;

applying a coating on the substrate to form a first coloring matcrial receiving layer containing inorganic particulates and a water-soluble resin;

applying at least one coating on the first coloring material receiving layer to form at least one top layer, wherein said at least one top layer is a crosslinking agent layer; and performing, immediately after the topmost layer of the coatings is formed, by a coating device, smoothing and metering treatments to the topmost layer simultaneously by a smoothing and metering device for conducting smoothing/metering treatments.

* * * * *